US007078686B2

(12) United States Patent
Roushall et al.

(10) Patent No.: US 7,078,686 B2
(45) Date of Patent: Jul. 18, 2006

(54) APPARATUS AND METHOD FOR ELECTRONICALLY DRIVING A QUADRUPOLE MASS SPECTROMETER TO IMPROVE SIGNAL PERFORMANCE AT FAST SCAN RATES

(75) Inventors: Randy Keith Roushall, Redwood City, CA (US); James Drewry Foote, Sunnyvale, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 212 days.

(21) Appl. No.: 10/919,535

(22) Filed: Aug. 16, 2004

(65) Prior Publication Data

US 2006/0016985 A1 Jan. 26, 2006

Related U.S. Application Data

(60) Provisional application No. 60/590,862, filed on Jul. 23, 2004.

(51) Int. Cl.
*H01J 49/42* (2006.01)

(52) U.S. Cl. ..... 250/292; 250/282

(58) Field of Classification Search ..... None
See application file for complete search history.

(56) References Cited

U.S. PATENT DOCUMENTS 3,735,287 A * 5/1973 Lowe ..... 250/292
3,920,986 A * 11/1975 Fies, Jr. ..... 250/282
5,463,219 A * 10/1995 Buckley et al. ..... 250/281

FOREIGN PATENT DOCUMENTS

GB 2 265 477 A 10/1992

OTHER PUBLICATIONS

Copy of Search Report dated Oct. 4, 2005.

* cited by examiner

*Primary Examiner*—Jack I. Berman

(57) ABSTRACT

An apparatus for electronically controlling a quadrupole in a mass spectrometer, comprises radio frequency (RF) drive circuitry and direct current (DC) drive circuitry coupled to a quadrupole, an RF control loop associated with the RF drive circuitry, a DC control loop associated with the DC drive circuitry, and control loop circuitry associated with the DC control loop, the control loop circuitry configured to alter a response of the DC control loop during a settling time period of a step response such that ion transmission through the quadrupole is greater during the settling time than if the response of the DC control loop during the settling time is unaltered.

16 Claims, 11 Drawing Sheets

APPARATUS AND METHOD FOR ELECTRONICALLY DRIVING A QUADRUPOLE MASS SPECTROMETER TO IMPROVE SIGNAL PERFORMANCE AT FAST SCAN RATES

CROSS-REFERENCE TO RELATED APPLICATION

This application claims priority to and the benefit of the filing date of U.S. Provisional Application No. 60/590,862, entitled "Apparatus and Method for Electronically Driving A Quadrupole Mass Spectrometer To Improve Signal Performance at Fast Scan Rates", filed on Jul. 23, 2004, which is incorporated herein in its entirety.

BACKGROUND

Mass spectrometry using a quadrupole ion filter, also referred to as quadrupole mass spectrometry, has been used for many years. Mass spectrometry using a quadrupole ion filter, referred to as a "quadrupole" uses four parallel rods that are supplied with a direct current (DC) voltage and a superimposed radio frequency (RF) voltage. The DC and RF voltages enable the quadrupole to scan a mass range by scanning over a range of preselected radio frequencies.

Typically, when scanning a mass range using the quadrupole to locate ions having a particular mass, the DC and RF voltages are maintained in a constant proportion to each other and are adjusted over a time period to filter ions having different mass. To scan a mass range, the DC and RF voltages are adjusted in steps that correspond to the atomic mass of the ions sought to be filtered. For example, the DC and RF voltages are adjusted to identify ions in, for example, 0.1 atomic mass unit (AMU) steps. Adjusting the DC and RF voltages over a mass range allows the mass spectrometer to identify different ions and associated isotopes according to the mass of the ion and isotope. Each step in DC and RF voltage, corresponding to the AMU step, requires the electrical circuitry that generates the respective DC and RF voltages to stabilize prior to analyzing (referred to as integrating) the results provided by the quadrupole and related detector. Unfortunately, for a given AMU step size, as the speed at which it is desirable to scan the quadrupole continues to increase, the amount of time available for analyzing the signal decreases.

Accordingly, a need exists for a way of maximizing the detection capability of a quadrupole as scan speed increases.

SUMMARY OF INVENTION

According to one embodiment an apparatus for electronically controlling a quadrupole in a mass spectrometer comprises radio frequency (RF) drive circuitry and direct current (DC) drive circuitry coupled to a quadrupole, an RF control loop associated with the RF drive circuitry, a DC control loop associated with the DC drive circuitry, and control loop circuitry associated with the DC control loop. The control loop circuitry is configured to alter a response of the DC control loop during a settling time period of a step response such that ion transmission through the quadrupole is greater during the settling time than if the response of the DC control loop during the settling time is unaltered.

Other apparatus, methods, and aspects and advantages of the invention will be discussed with reference to the figures and to the detailed description of the preferred embodiments.

BRIEF DESCRIPTION OF THE FIGURES

The invention will be described by way of example, in the description of exemplary embodiments, with particular reference to the accompanying figures in which.

DETAILED DESCRIPTION

While described below for use in a quadrupole mass spectrometer that scans ions from high mass to low mass, the apparatus and method for electronically driving a quadrupole in a mass spectrometer can be used when scanning ions from low mass to high mass.

Figure 1:
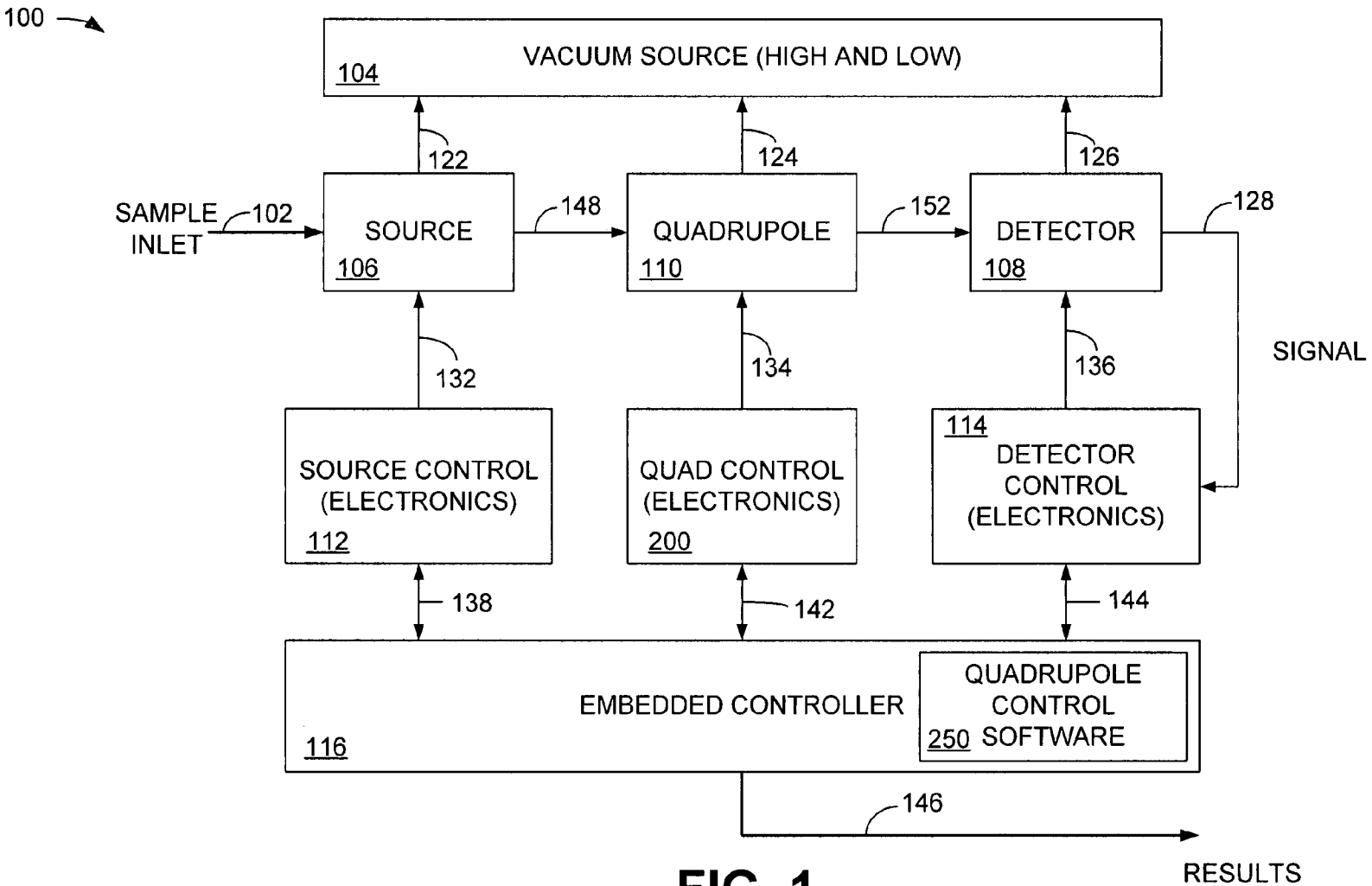
FIG. 1 is a block diagram illustrating a quadrupole mass spectrometer.

FIG. 1 is a block diagram illustrating a quadrupole mass spectrometer 100. A sample of material to be analyzed is transported via a sample inlet 102 to the source 106. The sample inlet can be, for example, a membrane or other restricted device used in sampling air and simple gases or can be a more sophisticated device such as a gas chromatography, liquid chromatography, or solid phase sampler. The source 106 generates ions from the material in the sample inlet 102. The source 106 could be an electron or chemical ionization source, an electrospray or atmospheric pressure source, or any other source that converts the material in the sample inlet 102 into single or multiple charged ions. The source 106 transports the ions to the quadrupole 110 via connection 148.

The quadrupole 110 is an ion mass filter that isolates or selects a particular ion in the sample based on the atomic mass of the ion. When used as an ion filter, and when appropriate RF and DC voltages are applied to the quadrupole 110, the quadrupole 110 selects, based on atomic mass, a particular ion from a plurality of ions generated by the source 106. The selected ion is then passed via connection 152 to the detector 108. The quadrupole 110 can be used to scan a mass range to locate particular ions within that mass range, or can be used to monitor a sample for the presence of a single ion in what is referred to as single ion monitoring, or "SIMming" for ions of particular mass.

The detector 108 collects ions from the quadrupole 110 and converts the ions to electrons (or another appropriate electronic signal) to measure signal intensity associated with the detected ions. A typical ion converter includes continuous or discrete conversion dynodes or photomultiplier transducers. The output signal from the detector 108 is provided connection 128 to the detector control electronics 114.

The vacuum source 104, which provides both high and low vacuum, evacuates the source 106 via connection 122, the quadrupole 110 via connection 124 and the detector 108 via connection 126 to produce the appropriate vacuum required for the different elements. The vacuum pumps (not shown) in the vacuum source 104 typically comprise rotary vane or dry pumps for low vacuum and turbo molecular or diffusion pumps to provide high vacuum.

The source control electronics 112 comprise high voltage and low voltage elements to control the source 106 via connection 132. The control includes controlling both the DC voltages and RF voltages for ion guides and controlling the ramped DC voltages that are changed as a function of the mass of the ions sought to be detected. The source control electronics 112 also include heater control, flow control and filament control if required. The quadrupole control electronics 200, a portion of which will be described in greater detail below, comprise high and low voltage RF and DC voltage generators for providing the voltages to the quadrupole 110 via connection 134. The quadrupole control electronics 200 may also include pre and post ion guides to support transmission of ions into or out of the quadrupole 110.

The detector control electronics 114 generate the voltages for the various types of detectors or ion conversion devices via connection 136. The detector control electronics 114 include electronic amplifiers to convert or boost the ion signal to measure signal intensity of the signal out of the detector 108. Some amplifiers (not shown) in the detector control electronics 114 are analog elements with various dynamic ranges, while other amplifiers are pulse counters that "count" the ions.

The embedded controller 116 controls the source control electronics 112, quadrupole control electronics 200 and the detector control electronics 114 within the quadrupole mass spectrometer 100 via connections 138, 142, and 144, respectively, and can be, for example, simple control circuitry or a fully embedded computer processor having an onboard operating system. In one embodiment in which software or firmware controls the response of the quadrupole control electronics 200, the embedded controller 116 includes software 250 to control the response of the RF and DC control electronics to be described below. Alternatively, firmware or discrete logic circuitry could be implemented instead of the software 250 to control the response of the RF and DC control voltages supplied by the quadrupole control electronics 200.

The output of the detector 108 on connection 128 is a signal representing the ion intensity and is used by the embedded controller 116 to correlate the sample of interest to provide a final measurement. The output of the embedded controller 116 on connection 146 comprises data that is used directly or indirectly by elements located downstream of the quadrupole mass spectrometer 100 to interpret and correlate the sample from the sample inlet to the final measurement. Typically, the results are mass spetra or another form of mass information related to the sample ions.

Figure 2:
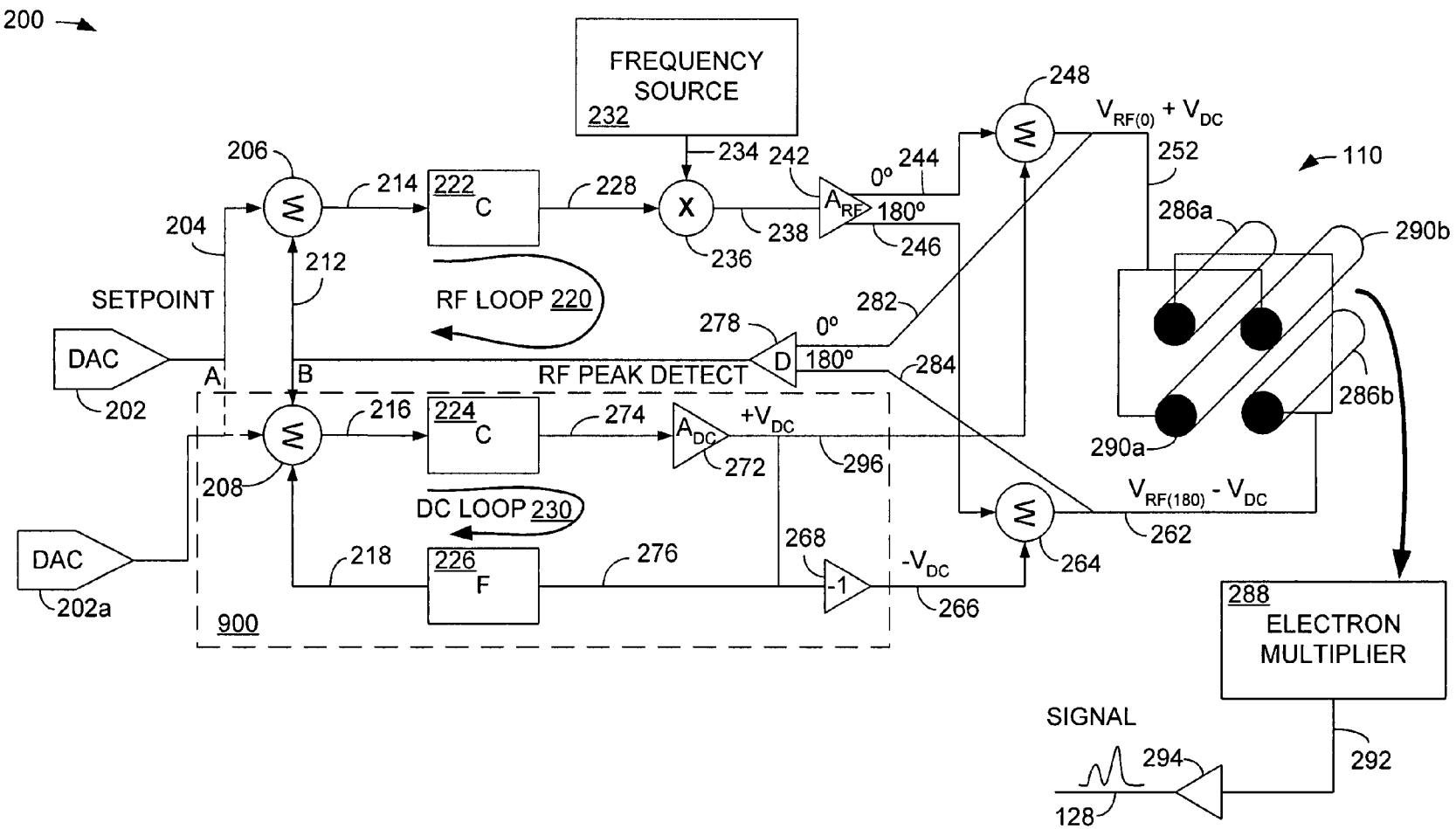
FIG. 2 is a block diagram illustrating a portion of the quadrupole control electronics of FIG. 1.

FIG. 2 is a block diagram illustrating a portion of the quadrupole control electronics 200 of FIG. 1. The quadrupole control electronics 200 comprise a digital-to-analog converter (DAC) 202, which generates the control voltages used to drive the elements in the RF control loop 220 and the elements in the DC control loop 230. In an alternative embodiment to be described below, separate DACs (202 and 202*a*) drive the RF control loop 220 and the DC control loop 230, respectively. In this example, the output of the DAC 202 via connection 204 is provided to a summing element 206. An RF peak detect signal on connection 212 also provides an input to the summing element 206. The summing element 206 in the RF control loop 220 provides an output via connection 214 to the compensation element 222. The compensation element 222 can be, for example, a resistive and capacitive network configured in an active or passive configuration.

The output of the compensation element 222 on connection 228 is supplied to a mixer 236. A frequency source 232, which can be, for example, an oscillator, also referred to as a local oscillator (LO), provides a frequency reference signal via connection 234 to the mixer 236. The mixer 236 combines the frequency reference signal on connection 234 with the signal on connection 228 and provides a signal at the appropriate RF amplitude on connection 238. In this embodiment, the frequency source 232 is a fixed frequency source and the mixer 236 modulates the amplitude of the reference signal on connection 234. The signal on connection 238 is supplied to an amplifier having a gain "$A_{RF}$," and which provides a 0° phase RF voltage signal on connection 244 and a 180° phase RF voltage signal connection 246.

The RF peak detect signal is also supplied as a feedback signal via connection 212 to the summing element 208 in the DC control loop 230. Alternatively, instead of using RF feedback as the input to the DC control loop 230, the output of the DAC 202 on connection 204 can also be supplied to the summing element 208 along path "A," or the output of DAC 202*a* can be supplied as input to the summing element 208. The summing element 208 also receives a feedback signal via connection 218 from the feedback element 226. The output of the summing element 208 on connection 216 is supplied to the compensation element 224, which can be similar to the compensation element 222 and which provides an output signal on connection 274 to the amplifier 272. The amplifier 272 has a gain "$A_{DC}$." The output of the amplifier 272 on connection 296 is a positive DC voltage signal abbreviated as $+V_{DC}$. The output of the amplifier 272 is also supplied to the feedback element 226 and as input to the amplifier 268. The amplifier 268 has a gain equal to "−1." The output of the amplifier 268 is a negative voltage $-V_{DC}$ on connection 266.

The 0° phase RF output of the amplifier 242 on connection 244 and the $+V_{DC}$ signal on connection 296 are supplied to the summing element 248. The output of the summing element 248 on connection 252 is a signal having an RF and DC component equal to $V_{RF(0)}+V_{DC}$. The 180° output of the amplifier 242 on connection 246 and the $-V_{DC}$ signal on connection 266 are supplied to the summing element 264. The output of the summing element 264 on connection 262 is a radio frequency and DC signal having the characteristic $V_{RF(180)}-V_{DC}$.

In this example, the quadrupole 110 comprises four parallel rods 286*a*, 286*b*, 290*a* and 290*b*. In this example, the rods 286*a* and 286*b* are coupled to the $V_{RF(180)}-V_{DC}$ signal on connection 262 and the rods 290*a* and 290*b* are coupled to the $V_{RF(0)}+V_{DC}$ signal on connection 252. In this manner, the quadrupole 110 is simultaneously driven by an RF and a DC voltage signal, where the RF signal supplied to elements 286*a* and 286*b* of the quadrupole 110 is 180° out of phase from the RF signal supplied to the elements 290*a* and 290*b* of the quadrupole 110, and where the DC voltage supplied to each of the elements 286*a* and 286*b* is opposite the polarity of the DC voltage supplied to the elements 290*a* and 290*b*.

The ions output from the quadrupole 110 are supplied to an electron multiplier 288 which converts the ions into electric current. The output of the multiplier 288 is provided on connection 292 to a detector amplifier 294. The detector amplifier 294 provides the signal output of the detector 108 (FIG. 1) via connection 128 to the detector control electronics 114 (FIG. 1).

The peak of the $V_{RF}$ voltage supplied to the quadrupole 110 is a function of the mass of the desired ion and is described by the formula:

$$V_{peak}=7.22\times N\times f^2\times R0^2 \quad \text{Equation 1}$$

where $V_{peak}$ is the peak pole voltage on the quadrupole 110, N is the AMU setting, f is the frequency of the RF signal in megahertz (MHz), and R0 is the radius of the quadrupole 110 in inches. The voltage $V_{DC}$ is a DC voltage applied to the elements of the quadrupole 110 in equal magnitude and at opposite polarity. One pair of elements receives the positive voltage and the other pair of elements receives the negative voltage. The DC voltage applied to the quadrupole 110 is described by the following equation:

$$V_{DC}=1.21\times N\times f^2\times R0^2 \quad \text{Equation 2}$$

where $V_{DC}$ is the DC voltage, N is the AMU setting, f is the RF frequency in MHz and R0 is the radius of the quadrupole 110 in inches. Similar to the RF voltage, the relationship for the DC voltage is known in the field of quadrupole technology, where equations 1 and 2 are referred to as Mathieu equations.

Figure 4:
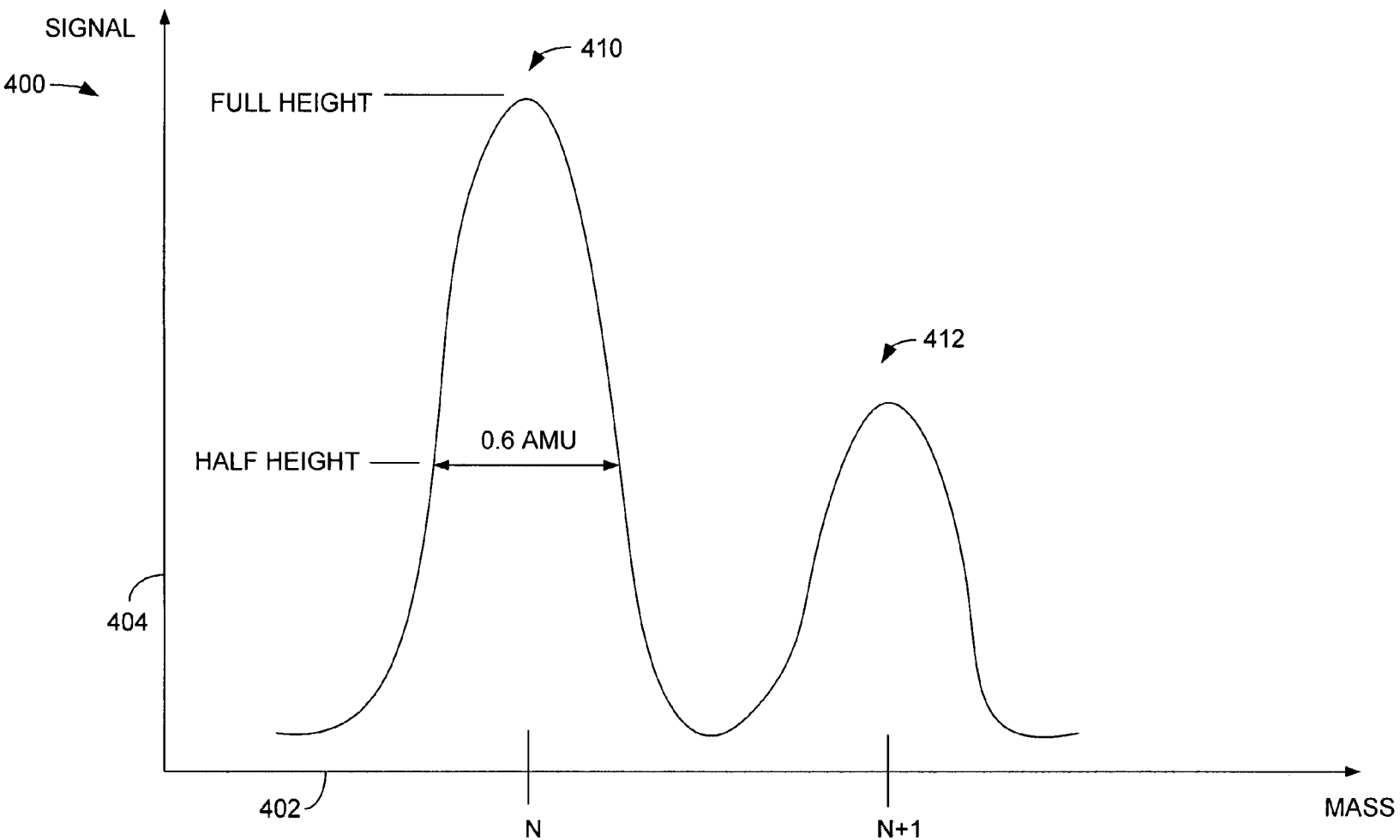
FIG. 4 is a graphical view illustrating an exemplary mass peak.

The RF and DC voltages are typically fine tuned to achieve an RF:DC ratio that forces a constant peak width in mass from a quadrupole 110. A larger RF:DC voltage ratio causes a wider peak width, and a smaller RF:DC voltage ratio causes a narrower peak width. For typical mass spectrometry, the peak width of an ion is typically between 0.5 and 0.7 AMU at half height of the signal and is shown in FIG. 4. Higher resolving technologies or instruments needing higher resolving power may use peaks narrower that 0.5 AMU. As peak widths approach and exceed 0.7 AMU, unit mass resolution begins to degrade. Generally, a larger RF:DC ratio allows better ion transmission through the quadrupole 110 than if the RF:DC ratio remains constant during a given time period.

When a quadrupole is scanned, an entire mass spectra is generated showing all ions present in a particular sample. The term "scan" refers to stepping the RF and DC voltages across a voltage range of the mass spectrometer in a certain time T, which in turn generates a spectra representing the different atomic weights of ions present in the scanned sample. At each step of a scan, the mass spectrometer determines the level of the ion signal through signal integration to determine the amount of signal (and the corresponding ion intensity) present at each step in the scan. After integration, the RF and DC voltages applied to the quadrupole 110 are again stepped. The size of the step is determined by the AMU step size. The process is repeated until an entire scan range is completed. Typically, a scan is continuously repeated to monitor the ion intensities in a sample as the ion intensities vary with time.

Typically, the goal of scanning is to acquire sufficient scans across a chromatographic peak. To accomplish this, it is desirable that the mass spectrometer scan quickly. This means that the mass spectrometer has to step quickly, integrate the signal quickly, move to the next step, and repeat the scan process.

Figure 3:
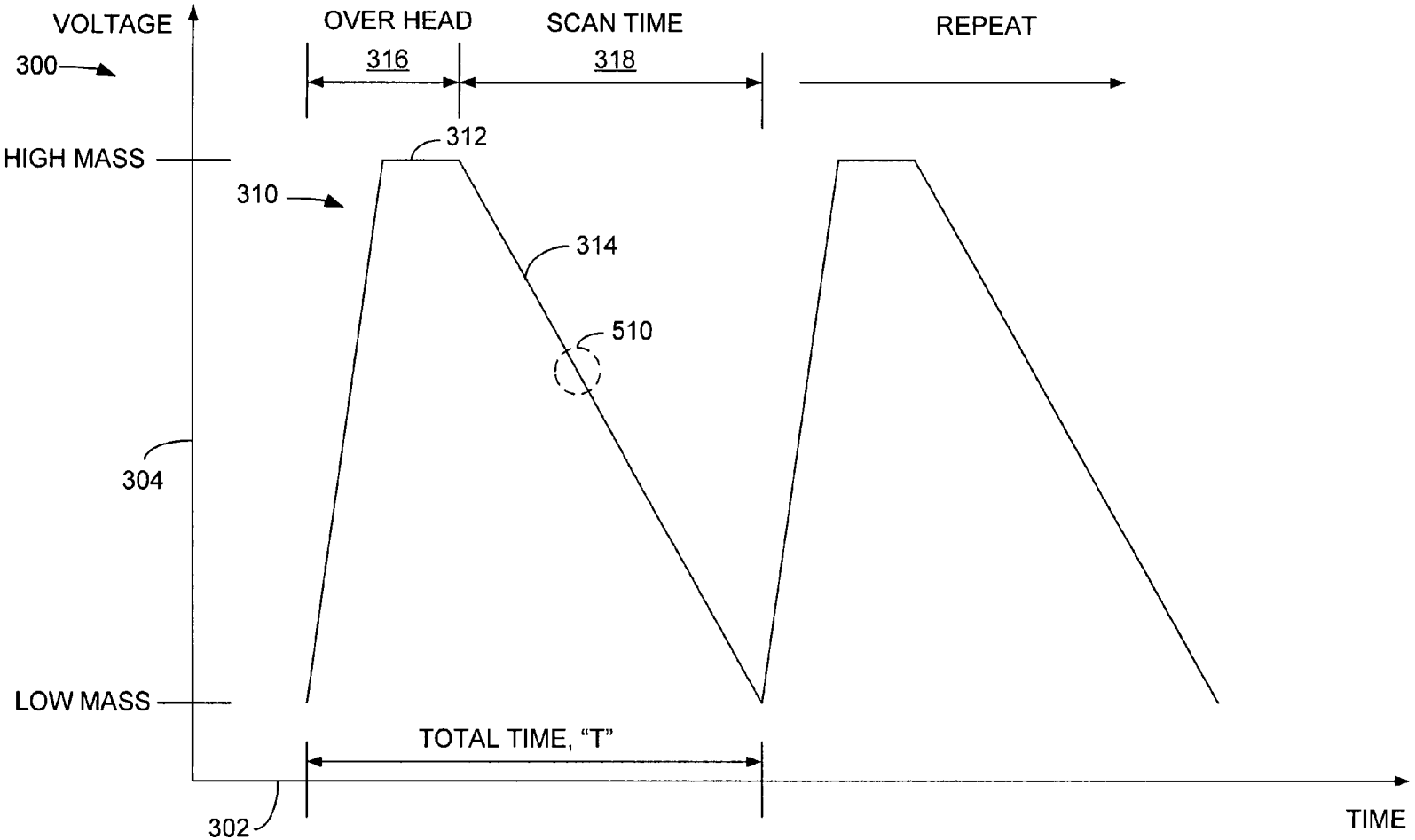
FIG. 3 is a graphical view illustrating the control voltage profile used to scan a mass spectrometer.

FIG. 3 is a graphical view 300 illustrating the control voltage profile used to scan a quadrupole mass spectrometer. In the example shown in FIG. 3, the quadrupole mass spectrometer is scanned from high mass to low mass, with the scan repeated as many times as possible for a run. The horizontal axis 302 represents time and the vertical axis 304 represents voltage. The curve 310 includes an overhead portion 312 and a scan portion 314 that occurs within a total time T. The time period 316 associated with the overhead portion 312 and the scan time 318 associated with the scan portion 314 comprise one scan. The total time, T, needed to generate a mass spectra for a chromatographic peak is the sum of the overhead time 316 and the scan time 318. The overhead time 316 includes, for example, voltage recovery time, data processing time, etc. To increase the number of data points collected per chromatographic peak, either the overhead time 316 or the scan time 318 has to be minimized. As will be described below, in accordance with an embodiment of the invention, the scan time 318 is analyzed, while the overhead time 316 is ignored.

FIG. 4 is a graphical view 400 illustrating an exemplary mass peak. The horizontal axis 402 represents mass while the vertical axis 404 represents the signal. The mass peak 410 represents the peak of the signal as the mass spectrometer is stepped from high mass to low mass as shown in FIG. 3. The mass spectrometer is tuned to have a mass peak width of 0.5 to 0.7 AMU wide at half height of signal. In the example shown in FIG. 4, the half height of the peak 410 is 0.6 AMU. The peak 412 represents an isotope having a mass of N+1 associated with the ion represented at mass peak 410, which has a mass, N. The mass peak 410 is acquired by stepping along the mass axis in the mass range of interest. At each step, for example a step of 0.1 AMU, the RF and DC control voltages stabilize, the signal is integrated, and the total ion mass (also referred to as "abundance" or signal height) is determined.

Figure 5:
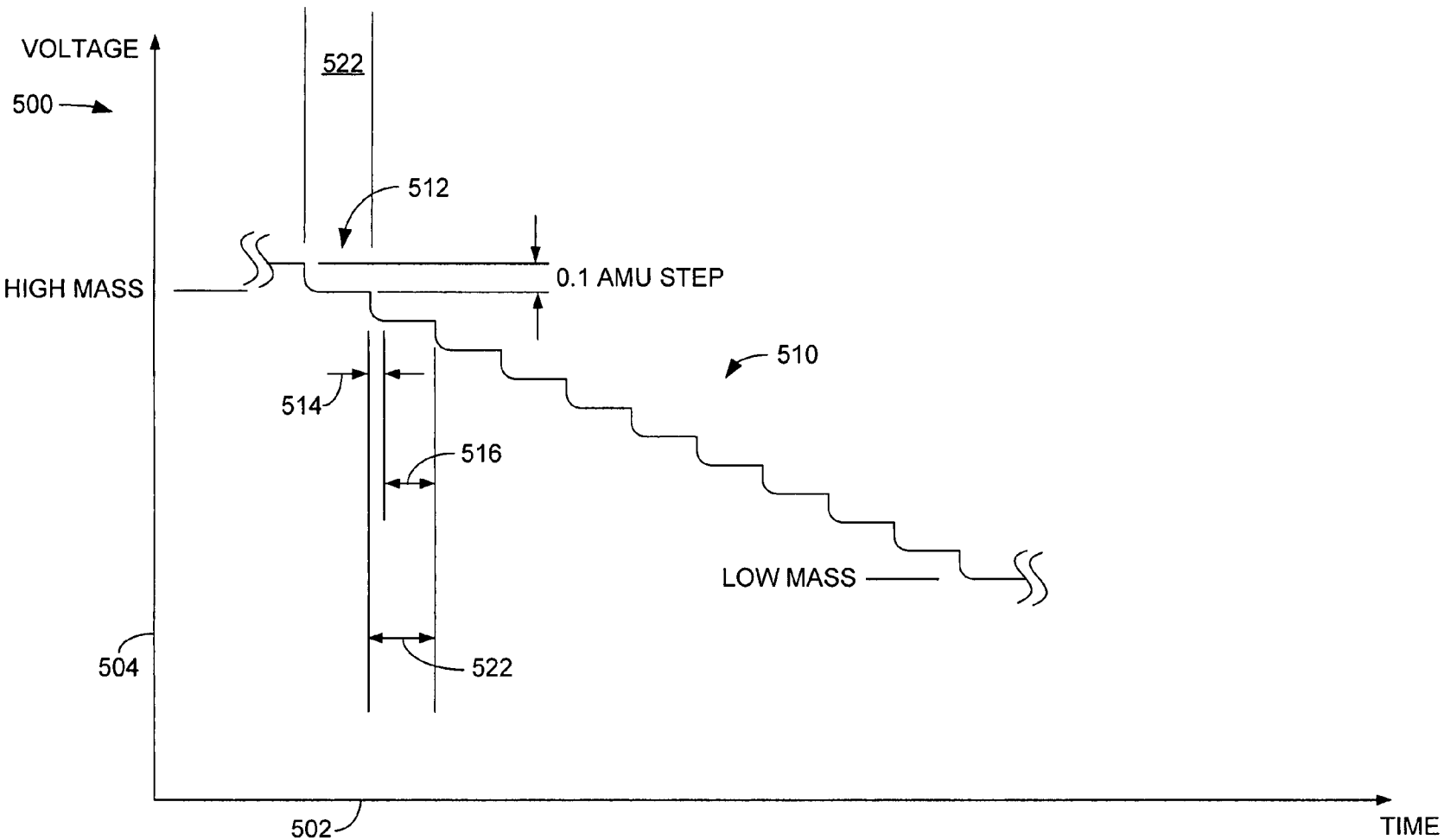
FIG. 5 is a graphical view illustrating a portion of the steps used to collect data across a mass peak.

FIG. 5 is a graphical view 500 illustrating a portion of the steps used to collect data across a mass peak. The horizontal axis 502 represents time and the vertical axis 504 represents voltage. The curve 510 represents a small portion of the scan portion 314 of FIG. 3. The scan portion 314 of FIG. 3 comprises hundreds or thousands of steps, a portion of which are shown in the curve 510 of FIG. 5. The curve 510 includes steps 512 that are 0.1 AMU in height and that occur over the entire scan time. Each step has a duration indicated at 522. Each step includes a settling time 514, during which the RF and DC control voltages provided by the quadrupole control electronics 200 to the quadrupole 110 stabilize, and an integration time 516. Once the RF and DC control voltages stabilize during the settling time 514, the signal delivered by the quadrupole 110 during the integration time 516 is the signal of interest. During this time, i.e., the integration time 516, the signal is integrated and the total ion mass for that mass position (i.e., atomic mass unit) is determined.

As scan speed increases, the integration time should ideally be shortened and the settling time minimized. In a typical application scanning at 1,000 AMU per second, it takes 1 millisecond (msec) to scan one AMU of range. For 0.1 AMU steps, 100 microseconds (μsec) are available for settling and integration time. For example, if the RF and DC control loops consume 20 μsec for settling time then the integration time available to analyze the signal from the quadrupole 110 is 80 μsec. As scan speed increases, smaller integration times are available. For example, if it is desired to scan the quadrupole 110 at 5,000 AMU per second (AMU/sec), then only 20 μsec is available for each 0.1 AMU step. This implies that the entire step time will be consumed by the settling of the RF and DC control loops, leaving no time to integrate the signal. Since the integration time decreases as scan speed increases, a certain amount of signal degradation and signal loss occurs. Furthermore, losses in signal-to-noise ratio and ion transit time through the quadrupole 110 become more important when trying to maintain signal strength.

Figure 6:
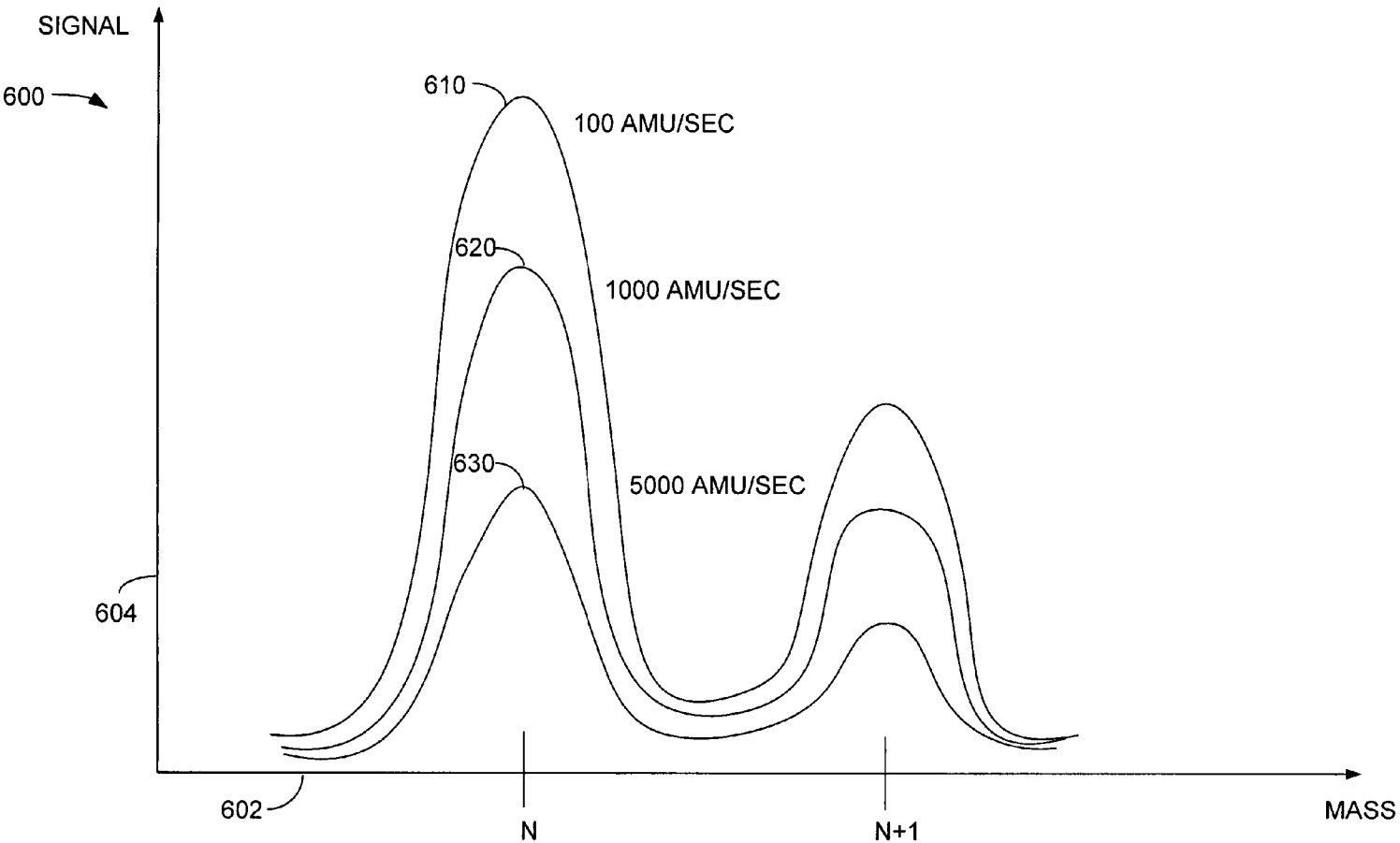
FIG. 6 is a graphical view illustrating the result of increasing scan speed using the technique shown in FIG. 5.

FIG. 6 is a graphical view 600 illustrating the result of increasing scan speed using the technique shown in FIG. 5. The horizontal axis 602 represents mass while the vertical axis represents the signal strength. The signal peak 610 is a result of scanning at 100 AMU/sec, the signal peak 620 is result of scanning at 1000 AMU/sec, and the signal peak 630 is the result of scanning at 5,000 AMU/sec. As shown, as the scan speed increases the signal strength continually decreases.

In accordance with an embodiment of the invention, the signal delivered by the quadrupole 110 will be integrated during the settling time. As shown in FIG. 5, the time period 522, which includes the settling time 514 and the integration time 516, is used to integrate the signal.

Unfortunately, there are drawbacks to integrating the signal during the settling time. For example, integrating during the settling time can produce inaccurate signal results. Further, sampling of the signal from a previous step can also negatively impact the signal measurement. Further still, signal sampling while the quadrupole 110 is transitioning between voltage levels can degrade the signal. In accordance with an embodiment of the invention, the response of the RF and DC control loops is altered during the settling time so that signal degradation when integrating during the settling time is minimized.

Figure 7A:
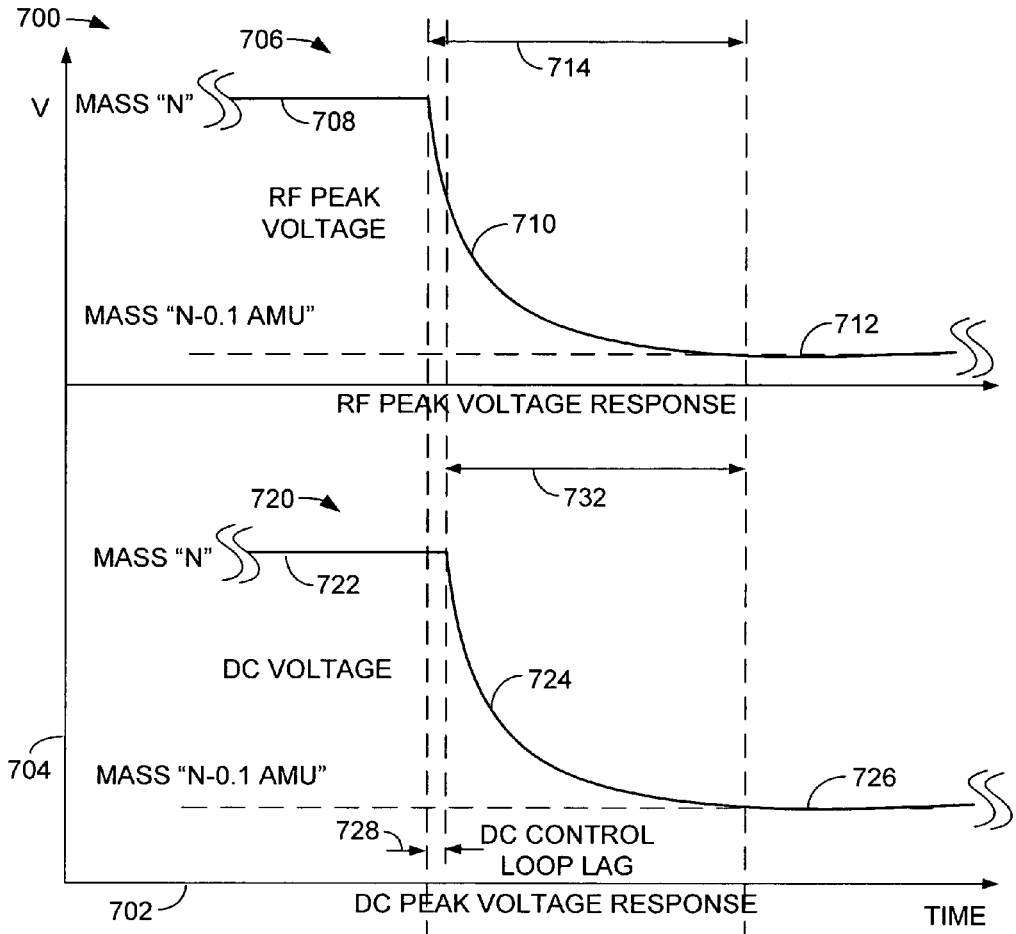
FIGS. 7A and 7B collectively illustrate the RF and DC control voltage response of the quadrupole control electronics of FIG. 2.
Figure 7B:
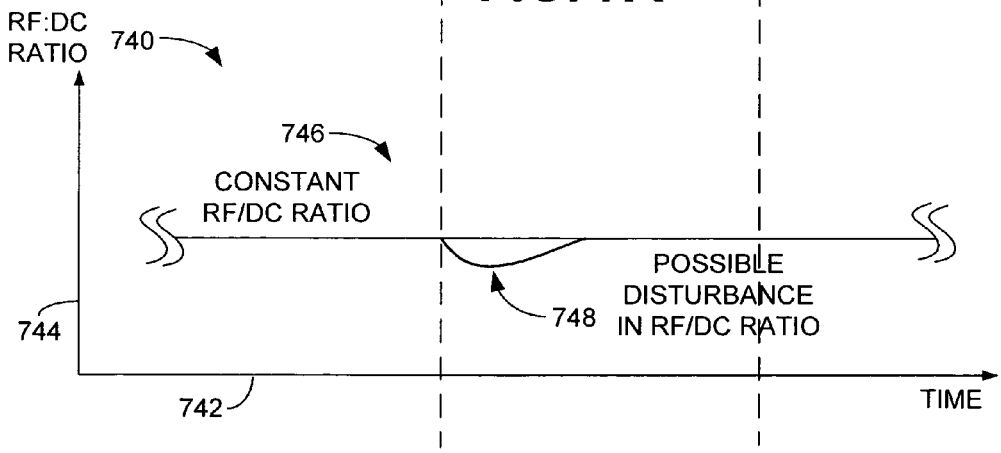

FIGS. 7A and 7B are graphical views collectively illustrating the RF and DC control voltage response of the quadrupole control electronics 200 of FIG. 2 at connections 252 and 262 (FIG. 2). The graph 700 includes a horizontal axis 702 that represents time and a vertical axis 704 that represents voltage. The RF peak voltage response is shown using curve 706 and the DC peak voltage response is shown using curve 720. When scanning from a mass "N AMU" to a mass "N-0.1 AMU," (i.e., from high mass to low mass) the RF peak voltage, which is stable during portion 708, transitions during the settling time period indicated at 714. This time period is referred to as the settling time 714. Also with reference to FIG. 2, the DC control voltage response, shown using curve 720, follows the RF peak voltage response 706 and includes a settling time 732.

In the example shown in FIG. 7A, there is a lag 728 between the DC voltage response and the RF voltage response. This lag is due to many factors, such as the response of the DC control loop 230, the response of the summation elements 248 and 264, the circuit topology implemented (i.e., input path "A" or input path "B" of FIG. 2) to provide input into summation element 208, as well as the response of the RF control loop 220. For example, if the DC control loop 230 were supplied using the DAC 202 along path "A," (or by a separate DAC 202*a*) then the DC voltage response shown in FIG. 7A would reduce or eliminate the lag associated with the RF voltage response, and may indeed lead the RF voltage response.

Regardless of any lag between the RF and DC control loops, as shown in FIG. 7B, a constant RF:DC voltage ratio is maintained before and after the settling time to maintain a constant peak width (FIG. 4). During the settling time, the RF:DC ratio may vary from being constant depending on the response of the RF and DC control loops, resulting in a possible disturbance in the RF:DC ratio shown at 748. This disturbance can degrade the performance of the quadrupole 110 at high scan speeds. As the quadrupole 110 is scanned faster, the data is sampled during the settling time. If the RF control loop 220 and the DC control loop 230 are not controlled properly during the settling time, mass resolution, transmission and sensitivity may be compromised.

Figure 8A:
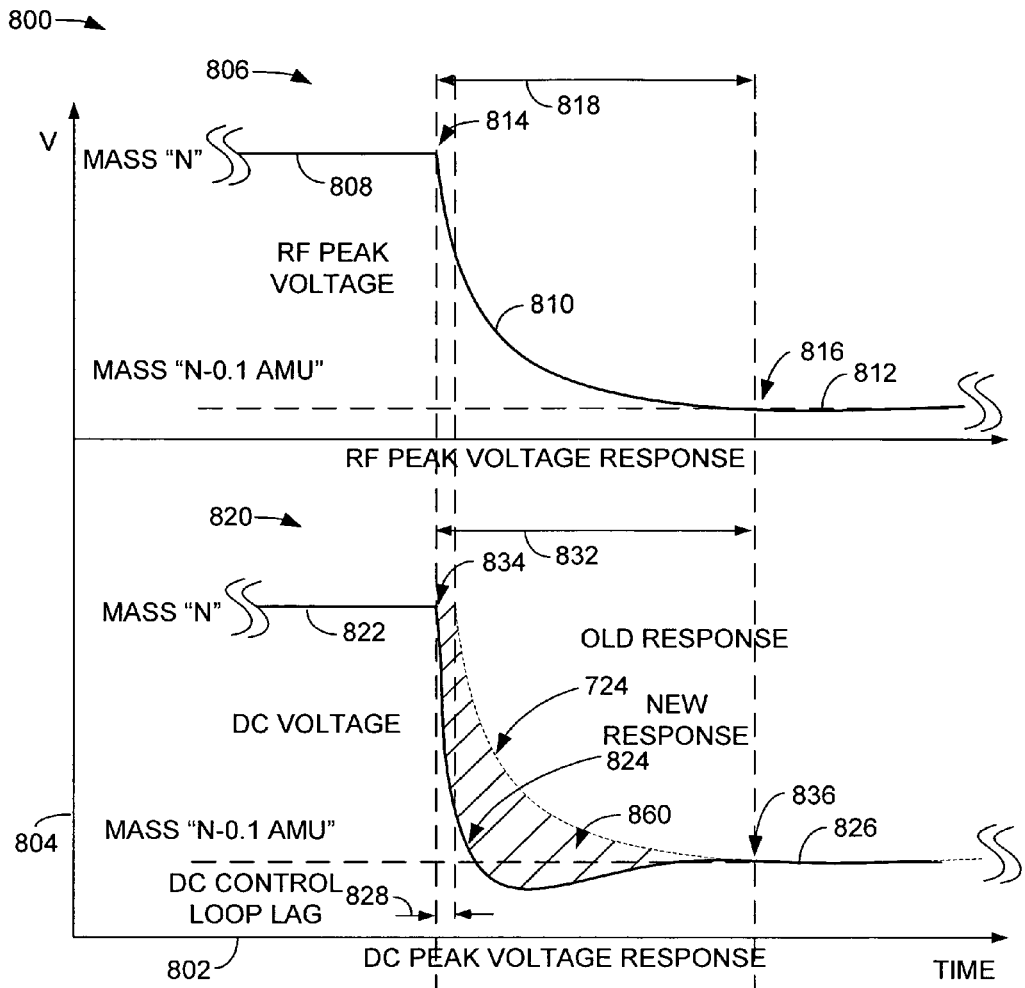
FIGS. 8A and 8B are graphical views collectively illustrating the operation of an embodiment of the invention.
Figure 8B:
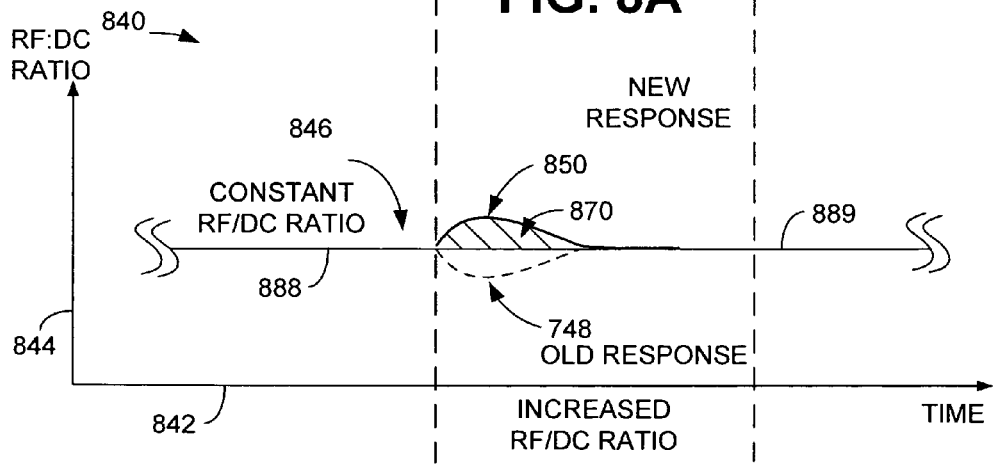

FIGS. 8A and 8B are graphical views collectively illustrating the operation of an embodiment of the invention. In FIG. 8A, the horizontal axis 802 represents time while the vertical axis 804 represents voltage. The RF peak voltage response shown at 806 is similar to the RF peak voltage response shown at 706 in FIG. 7A. The settling time 818 is defined as the time between point 814, at which time the RF peak voltage begins to transition to a different value (i.e., a different mass (i.e., 0.1 AMU step)), and the point 816, at which time the voltage transition is complete. The DC peak voltage response shown at 820 begins to transition at point 834, which, disregarding any lag between the RF and DC control loops, is substantially the same time as the RF peak voltage transition. In accordance with an embodiment of the invention, the response of the DC control loop is altered so that the altered DC control loop voltage response 824 results in the DC control loop reaching a voltage corresponding to the 0.1 AMU (in this example) step quicker than if the DC control loop response were not altered. The improved DC control loop response effectively improves ion transmission through the quadrupole 110 during the settling time 832. The prior DC voltage response is shown for reference in FIG. 8A and indicated at 724.

The RF:DC voltage ratio at points 814 and 834, and at points 816 and 836 are constant and are described by the Mathieu Equations 1 and 2 shown above. However, as shown by the curve portion 824, during settling time 832, the RF:DC voltage ratio is increased during the settling time 832, resulting in the response shown at 824. In this manner, ion transmission through the quadrupole 110 is improved during the settling time 832. As shown in FIG. 8B, the improved response 850 counters the old response shown at 748, resulting in improved signal performance and the ability to accurately integrate signal during the settling time. The embodiments of the invention do not alter the steady state RF:DC ratio during time segments 888 and 889, but only alter the RF:DC ratio during the settling time, as shown by response 850.

Figure 9:
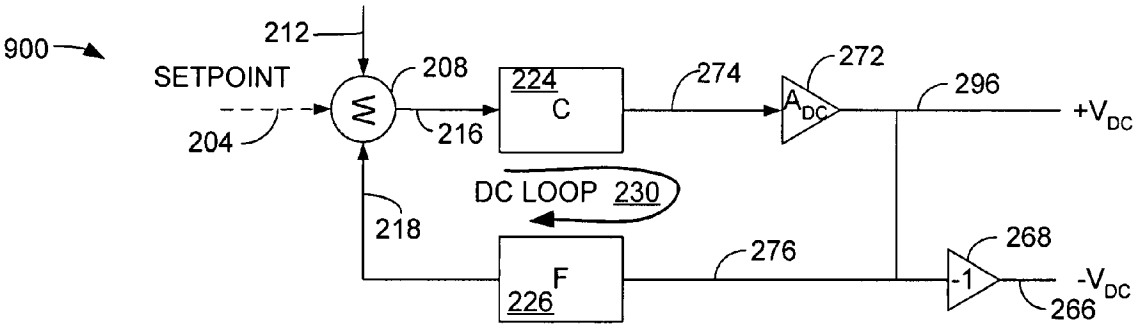
FIG. 9 is a block diagram illustrating the DC control loop of FIG. 2.

FIG. 9 is a block diagram 900 illustrating the DC control loop 230 of FIG. 2. In this embodiment, the effective setpoint voltage provided to the DC control loop 230 is changed, resulting in the voltage response shown in FIG. 8A. In FIG. 9, the setpoint is provided to the summing element 208 via connection 212, but may alternatively be provided via connection 204, or via DAC 202*a* (FIG. 2).

Figure 10:
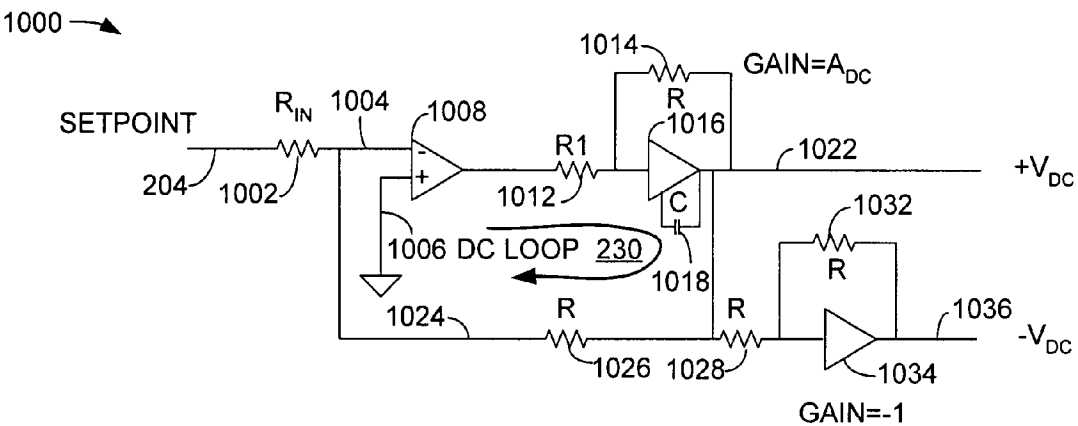
FIG. 10 is a schematic diagram illustrating the DC control loop of FIG. 9.

FIG. 10 is a schematic diagram 1000 illustrating the DC control loop 900 of FIG. 9. The setpoint voltage is supplied via connection 212, or alternatively, via connection 204, or from DAC 202*a* (FIG. 2) to a first resistance 1002. The output of the resistance 1002 is supplied to the inverting input 1004 of a summing amplifier 1008. The non-inverting input of the summing amplifier 1008 is coupled to ground via connection 1006. The output of the summing amplifier 1008 is provided to resistance 1012. The resistance 1012 is coupled to the amplifier 1016. The amplifier 1016 has a gain "$A_{DC}$," an associated resistance 1014 and an associated capacitance 1018. The output of the amplifier 1016 on connection 1022 is the positive DC voltage signal $+V_{DC}$.

The feedback path, F, includes resistance 1026. The output of the amplifier 1016 is supplied to amplifier 1034 through resistance 1028. The amplifier 1034 has a gain of −1. The amplifier 1034 includes a resistance 1032 and the output of the amplifier on connection 1036 is the negative DC voltage signal $-V_{DC}$. The signals on connection 1022 and 1036 are supplied to the quad 110 of FIG. 2.

Figure 11:
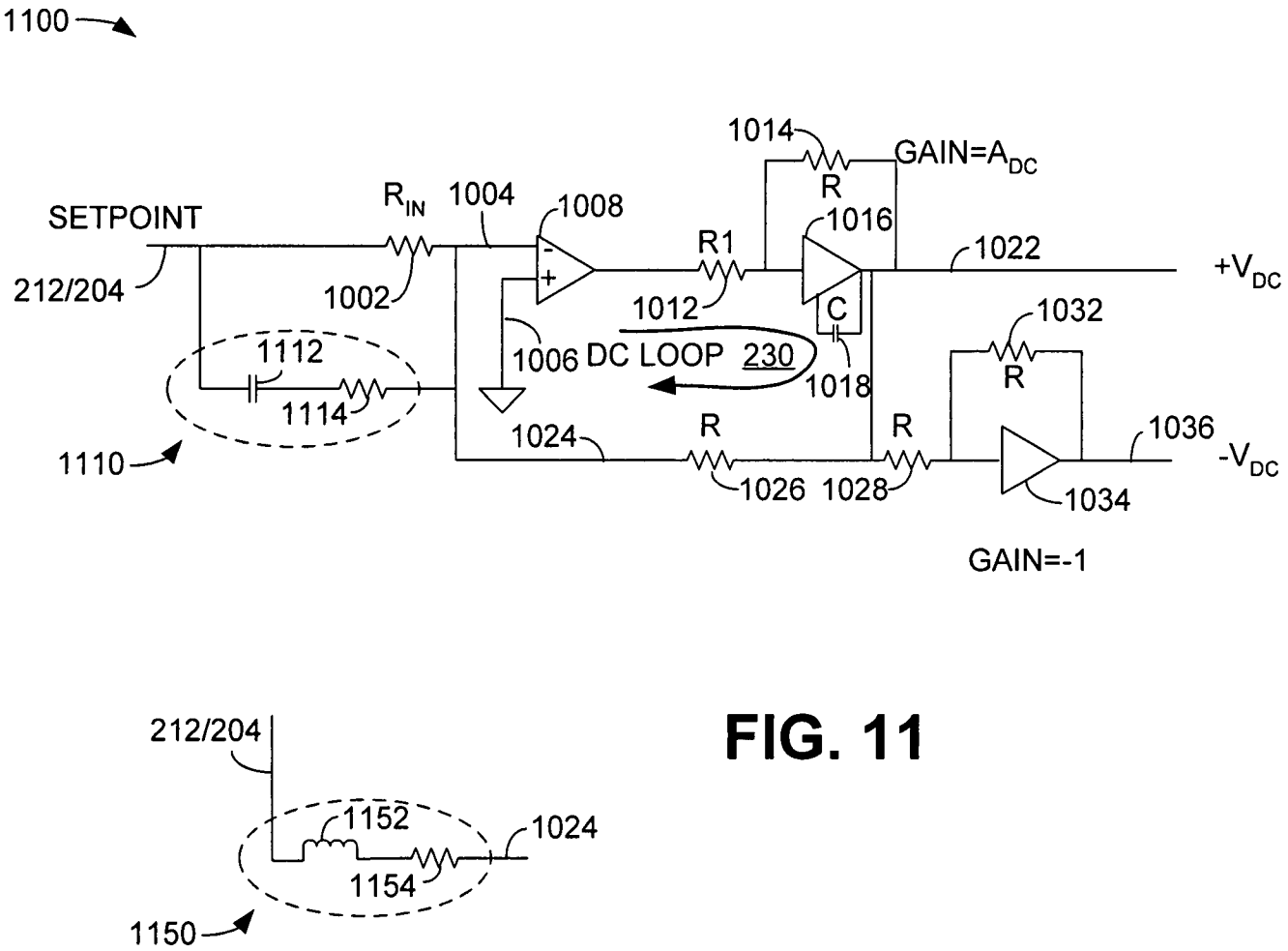
FIG. 11 is a schematic diagram illustrating one possible implementation of the invention.

FIG. 11 is a schematic diagram 1100 illustrating one possible implementation of the invention. The DC control loop 230 shown in FIG. 11 includes a feed forward network 1110. The feed forward network 1110 includes a capacitance 1112 and a resistance 1114, connected around the input summing resistor 1002 ($R_{IN}$). The feed forward network 1110 effectively changes the setpoint voltage of the DC control loop 230 by making the input impedance frequency-dependent. The result of implementing the feed forward network 1110 is a faster responding DC output voltage on connections 1022 and 1036. The feed forward network 1110 provides the proper adjustments to the $+V_{DC}$ and $-V_{DC}$ voltages to improve ion transmission through the quadrupole 110 during the settling time and avoid reducing ion transmission through the quadrupole 110 during the settling time.

In one embodiment, the value of the resistance 1114 is 21.5 Kohm and the value of the capacitance 1112 is 270 picofarads (pF) for a time constant of 5.8 microseconds (μs). This is with a value of Rin of 20.88 Kohm. Many other combinations of resistance and capacitance values would provide similar results. The end result is higher transmission of ions for faster scanning. The components within the feed forward network 1110 may be adjustable, thereby making the step response tunable. The range of adjustment of improvement is shown at 860 in FIG. 8A and at 870 in FIG. 8B. With the feed forward network 1110 driving the DC control loop 230, the RF:DC ratio can be controlled and adjusted to maintain or increase ion transmission through the quadrupole 110 during the settling time of the amplifiers while scanning the mass spectrometer 100. This improvement in ion transmission results in less signal loss at higher scan speeds due to the fine control of the RF and DC voltage step responses. Further, because the elements of the feed forward network, in this embodiment, are passive capacitances and resistances, they can be easily modified or adjusted to optimize the desired response of the DC control loop 230. The feed forward network 1110 is preferable when scanning from a high mass to a low mass.

The RF:DC ratio is altered during the settling time by the feed forward network 1110. In this embodiment, the feed forward network 1110 provides a higher gain on the DC amplifier 1016 and 1034 for a short amount of time, thus increasing the RF:DC ratio. The higher gain ceases after the capacitance 1112 charges to the new state, hence, returning to the steady state constant RF:DC ratio. If separate DACs were used, as mentioned above, firmware 250 would first alter the response of the DC control loop 230 and then alter the response of the RF control loop 220 to provide a similar increase in the RF:DC ratio for a short period of time.

Alternatively, a feed forward network 1150 can comprise an inductance 1152 and a resistance 1154, which can alter the DC response when scanning from a low mass to a high mass. Further, instead of a feed forward network 1110 or 1150, the response of the DC control loop 230 can be altered by driving it with a separate DAC 202*a* as shown in FIG. 2.

Figure 12:
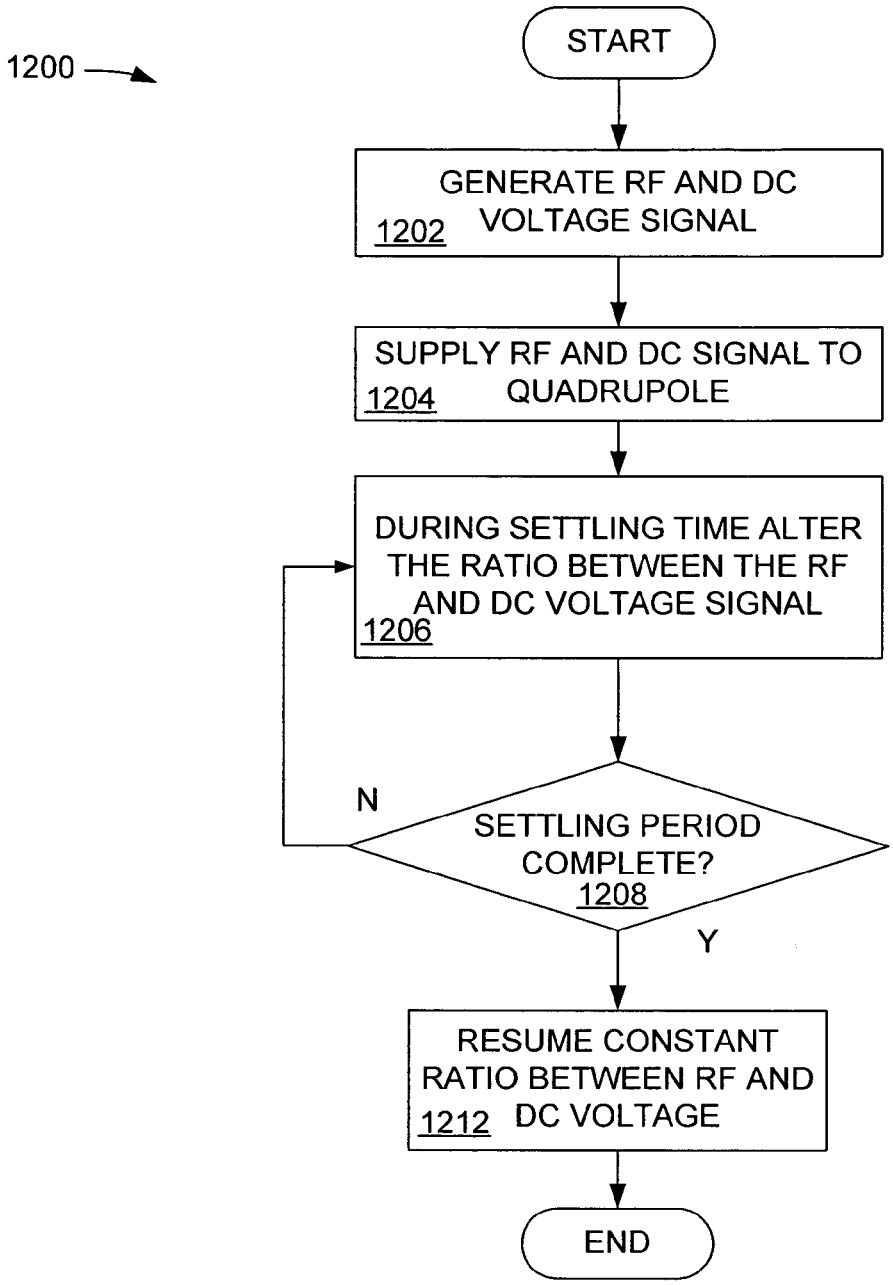
FIG. 12 is a flow chart illustrating the operation of one embodiment of the method for electronically controlling the quadrupole.

FIG. 12 is a flow chart illustrating the operation of one embodiment of the method for electronically controlling the quadrupole 110. The blocks in the flow charts can be executed in the order shown, out of the order shown, or substantially in parallel. In block 1202 the RF and DC control voltage signals are generated using the quadrupole control electronics 200 of FIG. 2. In block 1204 the RF and DC control voltages are supplied to the quadrupole 110. In block 1206, during the settling time of a step in voltage, the ratio between the RF and DC voltage signals is altered resulting in the DC control loop response shown in FIGS. 8A and 8B. In block 1208 it is determined whether the settling period is complete. If the settling period is not yet complete, the process returns to block 1206. However, if the settling period is complete, then, in block 1212, a constant ratio between the RF and DC voltages is resumed.

The foregoing detailed description has been given for understanding exemplary implementations of the invention only and no unnecessary limitations should be understood therefrom as modifications will be obvious to those skilled the art without departing from the scope of the appended claims and their equivalents.

We claim:

1. An apparatus for electronically controlling a quadrupole in a mass spectrometer, comprising:

radio frequency (RF) drive circuitry and direct current (DC) drive circuitry coupled to a quadrupole;

an RF control loop associated with the RF drive circuitry;

a DC control loop associated with the DC drive circuitry; and control loop circuitry associated with the DC control loop, the control loop circuitry configured to alter a response of the DC control loop during a settling time period of a step response such that ion transmission through the quadrupole is greater during the settling time than if the response of the DC control loop during the settling time is unaltered.

2. The apparatus of claim 1, wherein the control loop circuitry comprises a capacitive and resistive circuit configured to scan from high mass to low mass.

3. The apparatus of claim 1, wherein the control loop circuitry comprises an inductive and resistive circuit configured to scan from a low mass to a high mass.

4. The apparatus of claim 1, wherein the control loop circuitry comprises a digital-to-analog converter (DAC).

5. The apparatus of claim 1, wherein the altered response of the DC control loop allows the quadrupole ion transmission during the settling time to be greater than the ion transmission of the quadrupole when the DC control loop is unaltered.

6. The apparatus of claim 1, wherein a ratio of the control voltage of the RF to the DC control loop is increased.

7. A method for electronically controlling a quadrupole in a mass spectrometer, comprising:

generating a radio frequency (RF) and a direct current (DC) control voltage;

supplying the RF and DC control voltages to a quadrupole; and altering a ratio between the RF control voltage and the DC control voltage during a settling period associated with stepping the RF and DC control voltages.

8. The method of claim 7, wherein the DC control voltage is altered to lag the RF control voltage to scan from a low mass to a high mass.

9. The method of claim 7, wherein the DC control voltage is altered to lead the RF control voltage to scan from a high mass to a low mass.

10. The method of claim 9, wherein altering the ratio between the RF control voltage and the DC control voltage allows ion transmission through the quadrupole during the settling time to be greater than the ion transmission through the quadrupole when the ratio between the RF control voltage and the DC control voltage is unaltered.

11. An apparatus electronically controlling a quadrupole in a mass spectrometer, comprising:

means for generating a radio frequency (RF) and a direct current (DC) control voltage;

means for supplying the RF and DC control voltages to a quadrupole; and means for increasing a ratio between the RF control voltage and the DC control voltage during a settling period associated with stepping the RF and DC control voltages.

12. The apparatus of claim 11, wherein the means for altering a ratio between the RF control voltage and the DC control voltage comprises means for causing the DC control voltage to lag the RF control voltage to scan from a low mass to a high mass.

13. The apparatus of claim 11, wherein the means for altering a ratio between the RF control voltage and the DC control voltage comprises means for causing the DC control voltage to lead the RF control voltage to scan from a high mass to a low mass.

14. The apparatus of claim 11, wherein the means for altering a ratio between the RF control voltage and the DC control voltage comprises capacitive and resistive means.

15. The apparatus of claim 11, wherein the means for altering a ratio between the RF control voltage and the DC control voltage comprises inductive and resistive means.

16. The apparatus of claim 15, wherein the means for altering a ratio between the RF control voltage and the DC control voltage comprises digital-to-analog converter (DAC) means.

* * * * *